US010626869B2

(12) United States Patent
Nakamoto et al.

(10) Patent No.: US 10,626,869 B2
(45) Date of Patent: Apr. 21, 2020

(54) ELECTRIC COMPRESSOR

(71) Applicant: DENSO CORPORATION, Kariya, Aichi-pref. (JP)

(72) Inventors: Shinji Nakamoto, Kariya (JP); Koji Sakai, Kariya (JP); Yuji Kamiya, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 461 days.

(21) Appl. No.: 15/542,838

(22) PCT Filed: Jan. 27, 2016

(86) PCT No.: PCT/JP2016/000392
§ 371 (c)(1),
(2) Date: Jul. 11, 2017

(87) PCT Pub. No.: WO2016/121382
PCT Pub. Date: Aug. 4, 2016

(65) Prior Publication Data

US 2018/0003179 A1 Jan. 4, 2018

(30) Foreign Application Priority Data

Jan. 29, 2015 (JP) ..... 2015-015856

(51) Int. Cl.
*F04C 29/04* (2006.01)
*F04B 39/06* (2006.01)
(Continued)

(52) U.S. Cl.
CPC ..... *F04C 29/047* (2013.01); *F04B 35/04* (2013.01); *F04B 39/00* (2013.01); *F04B 39/06* (2013.01);
(Continued)

(58) Field of Classification Search
CPC .. F04C 29/047; F04C 29/0085; F04C 29/045; F04C 18/356; F04C 2240/30;
(Continued)

(56) References Cited

U.S. PATENT DOCUMENTS

2004/0109772 A1 6/2004 Ogawa et al.
2008/0181791 A1 7/2008 Iguchi et al.
2012/0308414 A1 12/2012 Ogawa et al.

FOREIGN PATENT DOCUMENTS

JP 2000196010 A 7/2000
JP 2002005024 A 1/2002
(Continued)

*Primary Examiner* — Mohamad A Musleh
(74) *Attorney, Agent, or Firm* — Harness, Dickey & Pierce, P.L.C.

(57) ABSTRACT

An electric compressor includes a compression portion that compresses and discharges a drawn fluid, and a motor of the compression portion. The electric compressor includes an actuator that includes multiple electronic components and drives the motor, a first casing that accommodates the actuator, and a second casing that accommodates the compression portion and the motor. The second casing includes a discharge passage in which a high-temperature fluid compressed by the compression portion flows. A limiting structure that limits the heat transfer from the fluid flowing in the discharge passage is provided between one of the electronic components and the discharge passage. The limiting structure includes a seat portion that defines a gap between a bottom surface of the one of the plurality of electronic components and the discharge passage. According to the electric compressor, the heat transfer from the fluid to the electronic components can be limited.

11 Claims, 6 Drawing Sheets

(51) Int. Cl.

| | |
|---|---|
| ***F04B 39/00*** | (2006.01) |
| ***F04B 35/04*** | (2006.01) |
| ***F04B 39/12*** | (2006.01) |
| ***F04C 29/00*** | (2006.01) |
| *F04C 18/356* | (2006.01) |

(52) U.S. Cl.
CPC ..... *F04B 39/121* (2013.01); *F04C 29/0085* (2013.01); *F04C 29/045* (2013.01); *F04C 18/356* (2013.01); *F04C 2240/30* (2013.01); *F04C 2240/40* (2013.01); *F04C 2240/403* (2013.01); *F04C 2240/603* (2013.01); *F04C 2240/808* (2013.01)

(58) Field of Classification Search
CPC ..... F04C 2240/40; F04C 2240/403; F04C 2240/603; F04C 2240/808; F04B 35/04; F04B 39/00; F04B 39/06; F04B 39/121
See application file for complete search history.

(56) References Cited

FOREIGN PATENT DOCUMENTS

| | | | |
|---|---|---|---|
| JP | 2004183631 | A | 7/2004 |
| JP | 2008184947 | A | 8/2008 |
| WO | WO-2012035767 | A1 | 3/2012 |

ELECTRIC COMPRESSOR

CROSS REFERENCE TO RELATED APPLICATIONS

This application is a U.S. National Phase Application under 35 U.S.C. 371 of International Application No. PCT/JP2016/000392 filed on Jan. 27, 2016 and published in Japanese as WO 2016/121382 A1 on Aug. 4, 2016. This application is based on and claims the benefit of priority from Japanese Patent Application No. 2015-015856 filed on Jan. 29, 2015. The entire disclosures of all of the above applications are incorporated herein by reference.

TECHNICAL FIELD

The present disclosure relates to an electric compressor that includes an electronic component generating heat and a compression mechanism, and the electronic component used in an actuator of the electric compressor.

BACKGROUND ART

A device cooling a motor by an intake refrigerant that is drawn by a compression mechanism is known as configurations for cooling the motor of an electric compressor in which a compression mechanism and the motor are integrated.

In an electric compressor described in Patent Document 1, a motor accommodation room and an inverter accommodation room are next to each other, and a housing is disposed between the motor accommodation room and the inverter accommodation room. A through-hole is provided in the housing, and one end of the through-hole contacts a base. A refrigerant in the motor accommodation room contacts the base through the through-hole, and accordingly the base is cooled. The base works as a heat-transfer board to cool electronic components.

PRIOR ART DOCUMENT

Patent Document

Patent Document 1: Japanese Patent No. 2002-5024

SUMMARY OF THE INVENTION

According to studies by the inventors of the present disclosure, the configurations of the above-described Patent Document 1 may lead to an increase in size of the electric compressor due to forming of the through-hole and additional components. Especially, when the configurations are intended to cool all of the electronic components, the electric compressor may be large since the electronic components include a large component.

In consideration of the above-described points, it is an objective of the present disclosure to provide an electric compressor capable of limiting, with a simple configuration, a heat transfer from a high-temperature refrigerant to electronic components, and an electronic component capable of limiting the heat transfer.

An electric compressor according to a first aspect of the present disclosure includes: a compression portion that compresses and discharges a drawn fluid; a motor that is a driving source of the compression portion; an actuator that includes multiple electronic components and actuates the motor; a first casing that accommodates the actuator; and a second casing that accommodates the compression portion and the motor. In the second casing, a discharge passage in which a high-temperature fluid compressed by the compression portion is provided. Between at least one of the electronic components and the discharge passage, a limiting structure that limits a heat transfer from the fluid flowing in the discharge passage is provided.

According to the first aspect, the actuator is accommodated in the first casing, and a compression portion and motor are accommodated in the second casing. In the second casing, the discharge passage in which the high-temperature refrigerant compressed by the compression portion flows is provided. Accordingly, a heat of the fluid flowing in the discharge passage may be transferred to the first casing. The actuator in the first casing includes multiple electronic components. The limiting structure that limits the heat transfer from the fluid flowing in the discharge passage is provided between at least one of the electronic components and the discharge passage. Accordingly, the heat transfer from the fluid to the electronic component can be limited. Since the amount of a heat generated by the electronic component is different depending on the electronic components, the limiting structure is provided according to the amount of the generated heat. Moreover, in consideration of an arrangement of the electronic components in the first casing, a space in the first casing can be used effectively. According to this, an increase in size of the compressor and the heat transfer to the electronic components can be limited.

An electronic component according to a second aspect of the present disclosure constitutes an actuator that actuates a driving power source of a compression portion. The electronic component includes: a casing that is an outer layer; an inside element that is provided in the casing; and a limiting portion that limits a heat transfer from a fluid compressed by the compression portion to the inside element. According to the second aspect, the electronic component constituting the actuator that actuates the driving power source of the compression portion includes the casing, the electronic element, and the limiting portion. The limiting portion limits the heat transfer from the fluid compressed by the compression portion to the electronic element. The heat transfer from the fluid to the electronic component can be limited. Accordingly, the electronic component can be prevented from being damaged by the heat of the fluid.

EMBODIMENTS FOR EXPLOITATION OF THE INVENTION

Figure 1:
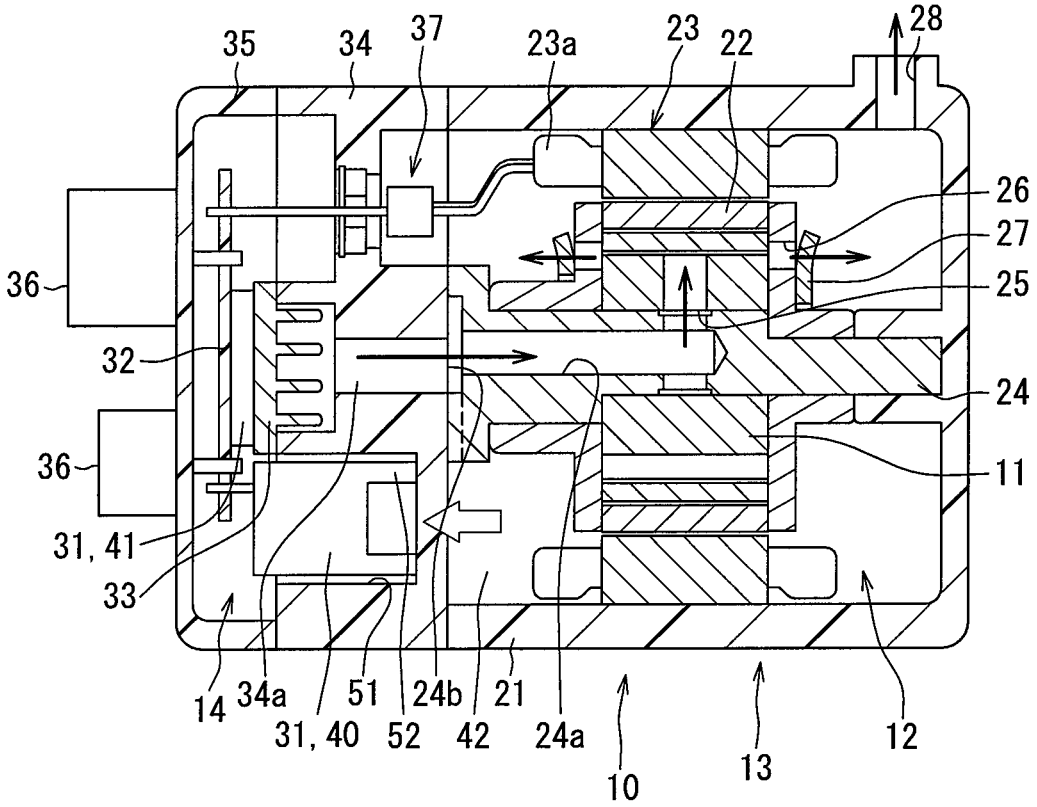
FIG. 1 is a sectional diagram simply illustrating a compressor according to a first embodiment.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described referring FIG. 1 and FIG. 2. A compressor 10 is an electric compressor 10 compressing a fluid drawn therein and discharging the fluid. The compressor 10 of the present embodiment is an electric refrigerant compressor. The refrigerant compressor 10 is one component constituting a vapor-compression refrigeration cycle apparatus. The refrigeration cycle apparatus includes a radiator, a decompressor and an evaporator in addition to the compressor 10.

The compressor 10 is provided in a refrigerant circuit of the refrigeration cycle apparatus. The compressor 10 draws and compresses a low-pressure refrigerant to discharge a high-temperature and high-pressure refrigerant. The radiator is located downstream of the compressor 10 to cools the high-temperature and high-pressure refrigerant discharged from the compressor 10. When a condensable refrigerant is used, the radiator may be called as a condenser.

The decompressor is located downstream of the radiator to decompress the high-pressure refrigerant that is cooled by the radiator. The evaporator is located downstream of the decompressor to evaporate the low-temperature and low-pressure refrigerant that is decompressed by the decompressor. The compressor 10 is located downstream of the evaporator to draw the low-temperature and low-pressure refrigerant that is evaporated in the evaporator. A variety of refrigerant such as fluorocarbon or carbon dioxide can be used as the refrigerant. The refrigeration cycle apparatus is typically applied to a refrigeration cycle of a vehicle air conditioner.

Next, the compressor 10 will be described. The compressor 10 includes a compression portion 11, a motor 13 having an electric motor 12, and an actuator 14. The motor 13 is a driving power source of the compressor 10. The electric motor 12 is a polyphase motor. The motor 13 includes a motor housing 21 accommodating the electric motor 12. The motor housing 21 has a cylindrical shape defining a hollow space having a circular column shape. The motor housing 21 has a circular cylindrical shape having a bottom plate on one end.

The electric motor 12 includes a rotor 22 and a stator 23. The rotor 22 is rotatable in regard to the motor housing 21. A rotation shaft 24 of the rotor 22 extends along an axial direction of the motor housing 21. An end of the rotation shaft 24 is rotatably supported by the bottom plate of the motor housing 21. The stator 23 is fixed to an inner wall of the motor housing 21. The stator 23 includes a stator wire 23*a*. A refrigerant passage 24*a* in which the drawn refrigerant flows is defined in the rotation shaft 24. The refrigerant flowing in the rotation shaft 24 reaches the compression portion 11.

The compression portion 11 is provided between the rotor 22 and the rotation shaft 24. The compression portion 11 is a rotary compression mechanism. The compression portion 11 draws the refrigerant through an intake port 25 communicating with the refrigerant passage 24*a* in the rotation shaft 24, and the compression portion 11 discharges the compressed refrigerant through a discharge port 26. A discharge valve 27 is provided in the discharge port 26 through which the refrigerant is discharged from the compression portion 11 to the motor housing 21. The discharge valve 27 prevents the refrigerant from flowing back. An outlet opening 28 is provided in the motor housing 21, and the refrigerant compressed by the compression portion 11 to be high-temperature and high-pressure is discharged through the outlet opening 28. Accordingly, the refrigerant passes an inside of the motor housing 21 as indicated by arrows in FIG. 1.

The actuator 14 supplies electricity to the electric motor 12 to drive the electric motor 12. The actuator 14 includes multiple electronic components 31, a circuit board 32, a cooling fin 33, an intake housing 34, and an inverter housing 35. The intake housing 34 has a circular cylindrical shape, and one end of the intake housing 34 is attached to one end of the motor housing 21 to be fixed to the motor housing 21. The other end of the intake housing 34 is attached to one end of the inverter housing 35 to be fixed to the inverter housing 35.

The intake housing 34 includes a refrigerant inlet (not shown in the drawings) from which the low-temperature and low-pressure refrigerant is drawn. The refrigerant inlet constitutes a passage extending through the intake housing 34. An inside space of the intake housing 34 and an inside space of the motor housing 21 are communicated with each other through a passage opening 24*b* of the rotation shaft 24. The space defined by the intake housing 34 provides a passage for the low-temperature and low-pressure refrigerant drawn to the compression portion 11.

The inverter housing 35 has a bottom plate on one end and a cylindrical shape like a shallow plate. The inverter housing 35 is a container accommodating multiple electronic components 31.

The circuit board 32 is a printed circuit board having one layer or multiple layers and made of thermosetting resin. The circuit board 32 is fixed to the bottom plate of the inverter housing 35. Multiple electronic components are mounted on the circuit board 32. Multiple electronic components are provided and aligned on the circuit board 32. The electronic component 31 includes an electric element disposed next to a power element 41.

The electronic component 31 includes an integrated circuit, common electric element such as a resistor, and the power element 41 controlling electricity supplied to the stator wire 23*a*. The electronic component 31 includes an electric filter member 40 such as a coil or a capacitor. The electric filter member 40 may be a component in which the capacitor and a discharge resistor are integrated with each other, for example.

The power element 41 is a high-temperature component that generates large amount of heat in the actuator 14, and the power element 41 accommodates multiple electric elements in one resin package. The power element 41 accommodates at least multiple switching elements constituting a switching bridge circuit for an inverter circuit. The switching element is constituted of an IGBT element or a power MOSFET element, for example. The power element 41 is capable of accommodating an accessory element such as an electric diode. The power element 41 is mounted on the circuit board 32.

The electric filter member 40 is a low-temperature component that generates heat smaller than the heat generated by the power element 41. The electric filter member 40 is larger in size than the other electronic components 31. The electric filter member 40 is not accommodated within the inverter housing 35, as shown in FIG. 1, and the electric filter member 40 is provided so as to extend from the inverter housing 35 to the intake housing 34. The electric filter member 40 is positioned adjacent to the motor housing 21.

The electronic components 31 include multiple connectors 36 mounted on the circuit board 32 and connected with an outside. Multiple connectors 36 may be provided as resin connectors. The connector includes a high voltage connector rated around 280 V and a low voltage connector rated around 12 V.

A connection member 37 that electrically connects the actuator 14 with the stator wire 23*a* is provided between the connector 36 and the stator wire 23*a*. The connection member 37 is constituted of a lead or a busbar, for example. The connector 36 penetrates the bottom plate of the inverter housing 35. The connector 36 electrically connects the actuator 14 with an outside circuit such as a control unit of an air conditioner.

The cooling fin 33 contacts the power element 41. A bonding agent that enhances a heat transfer can be provided between the cooling fin 33 and the power element 41. The cooling fin 33 is thermally connected with the power element 41. The cooling fin 33 is provided in the intake housing 34. Accordingly, the power element 41 is capable of dissipating heat to the drawn refrigerant through the cooling fin 33.

The actuator 14 works as a control unit controlling the compressor 10. The control unit is an electronic control unit (Electronic Control Unit). The control unit is capable of including at least one central processing unit (CPU) and at least one memory-mapped register (MMR) that stores programs and data. The control unit is a microcomputer including a memory media readable by a computer. The memory media non-transitorily stores programs readable by the computer. The memory media may be provided as a semiconductor memory or a magnetic disc.

The control unit may be provided as one computer or a pair of computer resources which are linked with each other by a data communication device. The program is executed by the control unit to cause the control unit to work as the device described in this specification, and the program causes the control unit to perform instructions described in this specification. The control unit provides various elements. At least a part of the elements can be called as a portion for performing instructions, and a part of the elements may be called as a constitutive block or a module.

The device and the functions provided by the control unit can be constituted of software only, hardware only, or a combination of software and hardware. For example, the control unit may constitute of an analogue circuit.

As described above, the compressor 10 of the present embodiment is a mechatronical product. The refrigerant is drawn from an intake opening of the intake housing 34. The drawn refrigerant that is low-temperature and low-pressure passes through the inside of the rotation shaft 24 in the motor housing 21 after passing through the cooling fin 33 in the intake housing 34. Subsequently, the refrigerant is compressed by the compression portion 11, and the compressed refrigerant that is high-temperature and high-pressure is discharged to the motor housing 21. The high-temperature and high-pressure refrigerant is discharged out of the motor housing 21 from the outlet opening 28. Accordingly, in the motor housing 21 that is a second housing, a discharge passage 42 in which the high-temperature and high-pressure refrigerant compressed by the compression portion 11 flows is provided.

The electric filter member 40 is positioned adjacent to a passage in which the discharged refrigerant that is high-temperature flows. Accordingly, a heat of the high-temperature refrigerant may be transferred through the intake housing 34, and the electric filter member 40 may increase in temperature.

Figure 2:
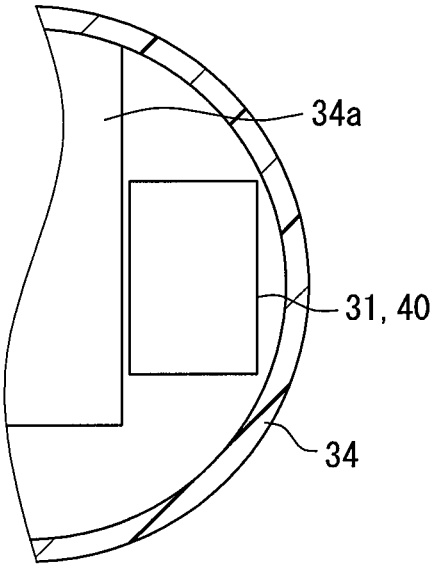
FIG. 2 is a plan view illustrating a part of the compressor.

In the present embodiment, a limiting structure is provided between the electric filter member 40 and the discharge passage 42, as shown in FIG. 1. The limiting structure limits a heat transfer from the refrigerant flowing in the discharge passage 42 to the electric filter member 40. The limiting structure is a limiting portion that decreases the heat transfer. The limiting structure is integrated with a discharge passage 42 side of the electric filter member 40, and the limiting structure is provided as the limiting portion limiting the heat transfer. The limiting portion is a gap forming portion 51 that defines an empty space, in the present embodiment.

As shown in FIG. 1, a rib 52 is provided at a bottom part of the electric filter member 40 to provide a gap between the electric filter member 40 and the intake housing 34. According to this, not whole surface of the electric filter member 40 contacts the inner wall of the intake housing 34, but only the rib 52 contacts the inner wall to provide an empty space. Accordingly, a layer of air is provided between the electric filter member 40 and the inner wall of the intake housing 34. A heat is hard to be transferred in the empty space. Accordingly, the heat is hard to be transferred compared to a case where the electric filter member 40 is directly provided on the inner wall, and the electric filter member 40 is unlikely to be affected by the heat of the discharged refrigerant. Accordingly, a temperature increase of the electric filter member 40 can be small.

As described above, in the compressor 10 of the present embodiment, the inverter housing 35 that is a first casing and the intake housing 34 accommodate the actuator 14, and the motor housing 21 that is a second casing accommodates the compression portion 11 and the motor 13. In the motor housing 21, the discharge passage 42 in which a high-temperature fluid compressed by the compression portion 11 flows is provided. Accordingly, the heat of the fluid flowing in the discharge passage 42 may be transferred to the inverter housing 35. The actuator 14 in the inverter housing 35 includes multiple electronic components 31. Between the electric filter member 40 and the discharge passage 42, the gap forming portion 51 that is the limiting structure limiting the heat transfer from the fluid flowing in the discharge passage 42 is provided. According to this, the heat transfer from the fluid to the electric filter member 40 can be limited.

Since the amount of the heat generation depends on the electronic component 31, the limiting structure is provided in the electric filter member 40 in which the amount of the heat generation is comparatively small, and the cooling fin 33 is provided on the power element 41 in which the amount of the heat generation is large. According to this, the space inside the inverter housing 35 can be used effectively. Accordingly, an increase in size of the compressor 10 can be limited, and the heat transfer to the electronic components 31 can be limited.

In other words, the temperature increase of the electric filter member 40 due to the heat transferred from a discharge room can be limited even in a configuration in which the temperature in the opposite side of a separation wall from a side where the electric filter member 40 is provided becomes high. According to this, a decrease in durability of the electric filter member 40 can be avoided, and an upsizing for improving a cooling property can be avoided.

In the present embodiment, the intake passage 34*a* in which the low-temperature refrigerant drawn by the compression portion 11 flows is provided in the intake housing 34 that is the first casing. Between the power element 41 that is the high-temperature component and the intake passage 34*a*, the cooling fin 33 having a heat dissipation structure in which the heat from the fluid flowing in the intake passage 34*a* is easy to be transferred. According to this, the high-temperature component can be cooled by the intake refrigerant. However, if all of the electronic components 31 are cooled by the drawn refrigerant, the intake passage 34*a* may be complicated, and a space in the inverter housing 35 for placing the electronic components 31 may become large. According to the present embodiment, a low-temperature component such as the electric filter member 40 is not cooled by the drawn refrigerant, and the temperature increase of the low-temperature component is limited by limiting the heat transfer from the high-temperature refrigerant. Since arrangement and configurations are decided according to characteristics in heat generation of the electronic component 31, and since some electronic components 31 has configurations in which thermal conductance from the discharge passage 42 is low, thermal issues of the electronic components 31 can be surely avoided without a cooling structure using the intake refrigerant.

In the present embodiment, the limiting structure is the limiting portion that is provided on the side of the electric filter member 40 facing the discharge passage 42. The limiting portion is provided integrally with the electric filter member 40 to limit the heat transfer. According to this, the limiting structure can be obtained just by changing the configurations of the electric filter member 40.

Moreover, in the present embodiment, the limiting portion is the gap forming portion 51 that defines an empty space. Accordingly, the limiting structure can be provided just by providing a gap.

Further, in the present embodiment, a self-generated heat of the electric filter member 40 is hard to be spread by the heat transfer. Accordingly, the present disclosure is also effective when a component having a small self-generated heat such as a film condenser is used as the electric filter member 40.

Second Embodiment

Next, a second embodiment of the present disclosure will be described referring FIG. 3. In the present embodiment, an intake passage 34*a* is provided between a discharge passage 42 and an electric filter member 40.

Figure 3:
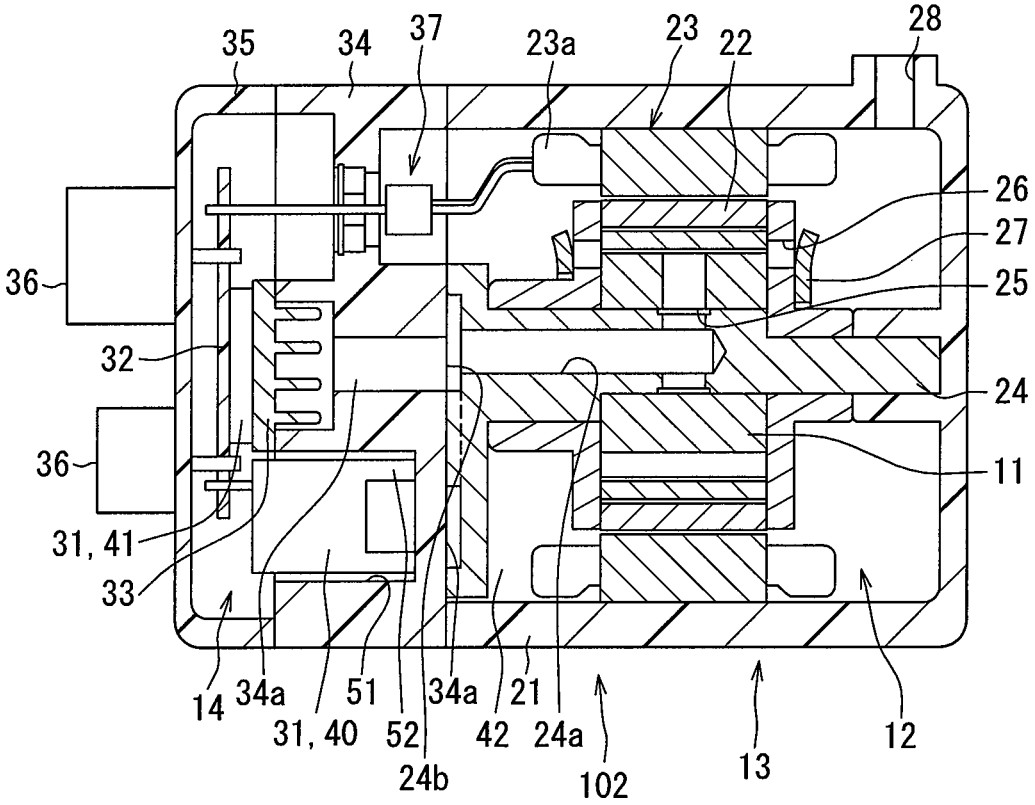
FIG. 3 is a sectional diagram simply illustrating a compressor according to a second embodiment.

As shown in FIG. 3, the intake passage 34*a* extending from an intake opening to a refrigerant passage 24*a* in a rotation shaft 24 is provided in a motor housing 21. The intake passage 34*a* in the motor housing 21 is adjacent to an inner wall of an intake housing 34, and the intake passage 34*a* is located on an opposite side of the inner wall from the electric filter member 40. According to this, the heat from the discharge passage 42 is more unlikely to be transferred to the electric filter member 40.

Third Embodiment

Next, a third embodiment of the present disclosure will be described referring to FIGS. 4, 5. In the present embodiment, a configuration of an electric filter member 403 that is a low-temperature component is characteristic.

The electric filter member 403 includes a cover resin 61, an inside element 62, and a heat insulation portion 63. The inside element 62 performs a function of the electric filter member 403. The cover resin 61 covers the inside element 62 to protect the inside element 62. A thermal conductivity of the heat insulation portion 63 is lower than that of the cover resin 61, and the heat insulation portion 63 covers at least a part of the cover resin 61. The heat insulation portion 63 may be a limiting structure or a limiting portion.

Figure 4:
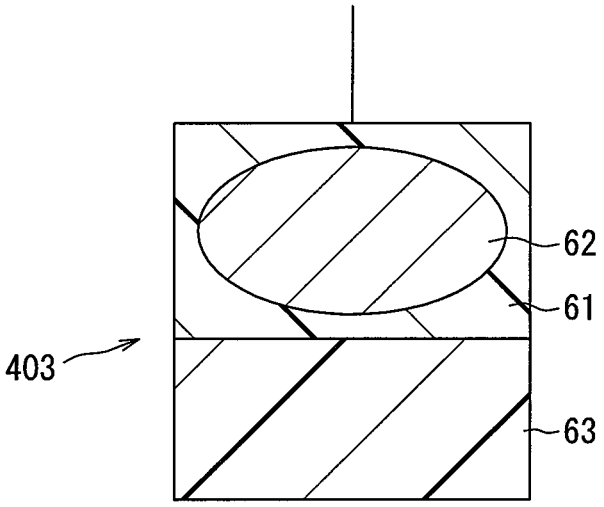
FIG. 4 is a sectional diagram illustrating a part of an example of an electric filter member according to a third embodiment.

In an example shown in FIG. 4, the heat insulation portion 63 is provided on a side of the cover resin 61 facing a discharge passage 42. According to this, a heat transfer from the discharge passage 42 to the inside element 62 is limited.

Figure 5:
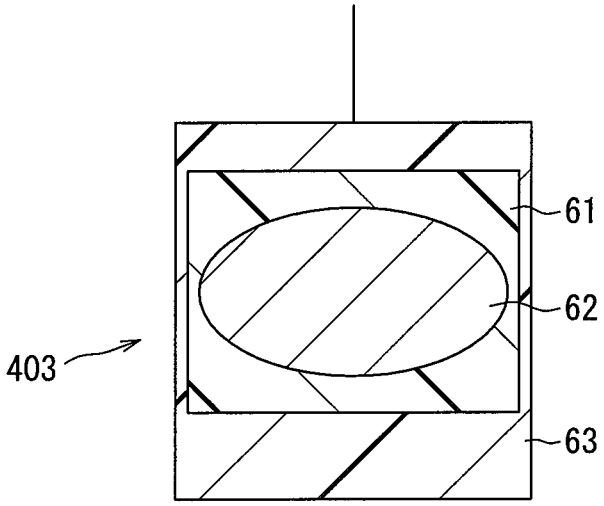
FIG. 5 is a sectional diagram illustrating a part of another example of the electric filter member according to the third embodiment.

In another example shown in FIG. 5, the heat insulation portion 63 completely covers the cover resin 61. Accordingly, the heat insulation portion 63 is a casing that constitutes an outer layer of the electric filter member 403. According to this, a heat transfer from an outside to the inside element 62 is limited.

In the present embodiment, since the electric filter member 403 includes the heat insulation portion 63, an increase in temperature of the inside element 62 of the electric filter member 403 caused by the high-temperature refrigerant is limited.

In other words, the electric filter member 403 includes the heat insulation portion 63 between an outside and the inside element 62, and between the outside and the cover resin 61. The heat insulation portion 63 is provided for decreasing the thermal conductance. According to this, a strength of the electric filter member 403 is increased compared to the first embodiment in which the rib 52 is provided in the electric filter member 40, and a temperature increase of the electric filter member 403 can be limited.

Fourth Embodiment

Figure 6:
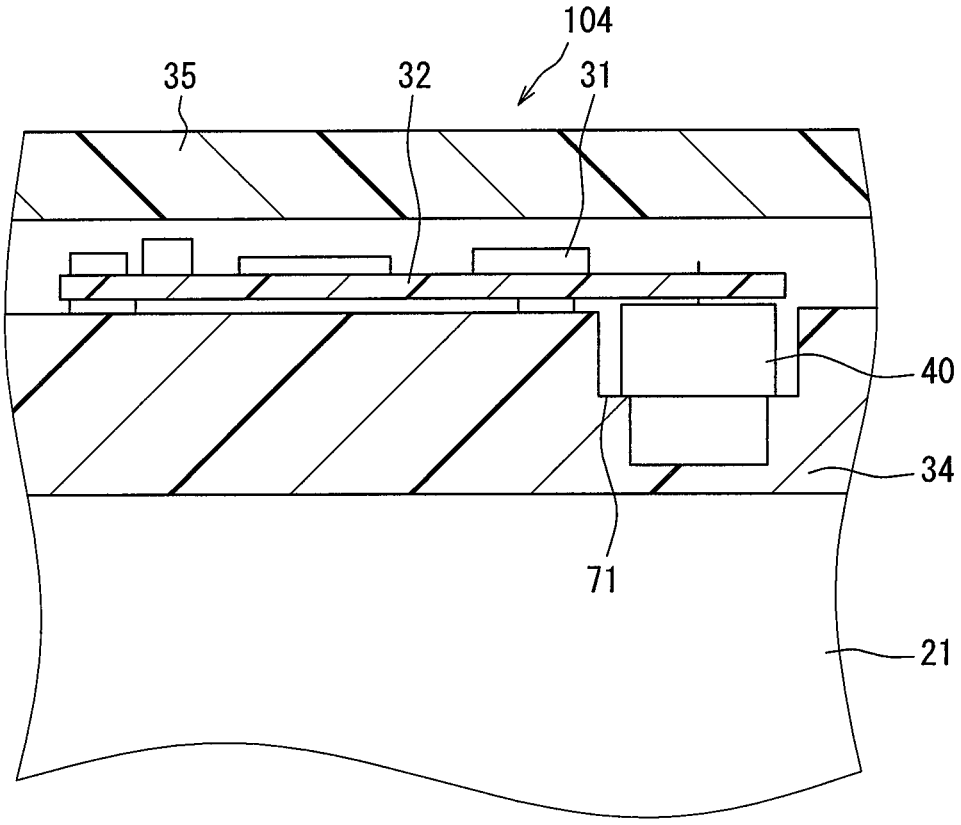
FIG. 6 is a sectional diagram illustrating a part of a compressor according to a fourth embodiment.

Next, a fourth embodiment of the present disclosure will be described referring to FIG. 6. In the present embodiment, a limiting structure is provided in an intake housing 34. In FIG. 6, an exterior of a motor housing 21 is shown to facilitate understanding.

The limiting structure is a step portion 71 provided integrally with the intake housing 34, and the step portion 71 defines a gap between a bottom surface of an electric filter member 40 and a discharge passage 42. In other words, a step is formed at a part of the intake housing 34 on which the electric filter component 40 is positioned. According to this, an area where the intake housing 34 and the electric filter member 40 contact to each other is small, and an air layer is provided between the intake housing 34 and the electric filter member 40.

Since the air layer is provided by the step portion 71 between the electric filter member 40 and the discharge passage 42, a heat transfer from the discharge passage 42 can be limited. As described above, the limiting structure can be obtained by forming the step portion 71 in the intake housing 34. Accordingly, a temperature increase of the electric filter member 40 can be limited without changing a shape of the electric filter member 40.

Fifth Embodiment

Figure 7:
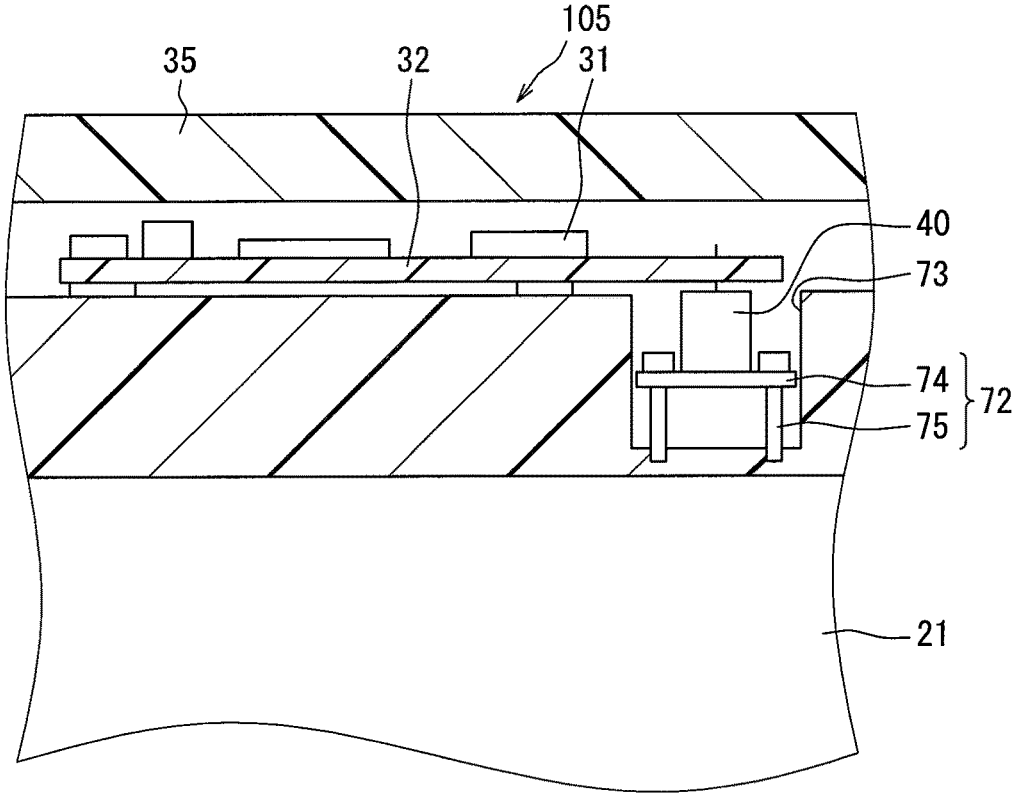
FIG. 7 is a sectional diagram illustrating a part of a compressor according to a fifth embodiment.

Next, a fifth embodiment of the present disclosure will be described referring to FIG. 7. In the present embodiment, a limiting structure is provided in an intake housing 34. In FIG. 7, an exterior of a motor housing 21 is shown to facilitate understanding.

The limiting structure is a seat portion 72 provided separately from the intake housing 34, and the seat portion 72 provides a gap between a bottom surface of an electric filter member 40 and a discharge passage 42. A groove 73 accommodating the electric filter member 40 is formed in the intake housing 34. The seat portion 72 is provided at the bottom of the groove 73. The seat portion 72 includes a metal board 74 that provides a surface on which the electric filter member 40 is attached, and a supporting pole 75 that supports the metal board 74. The bottom of the supporting pole 75 is fixed to the intake housing 34 by screwing, for example.

Since an air layer is provided by the seat portion 72 between the electric filter member 40 and the discharge passage 42, a heat transfer from the discharge passage 42 can be limited. The limiting structure can be obtained by providing the seat portion 72 in the intake housing 34, as described above. Moreover, since the heat can be dissipated through the metal board 74, a temperature increase can be limited more effectively.

Sixth Embodiment

Figure 8:
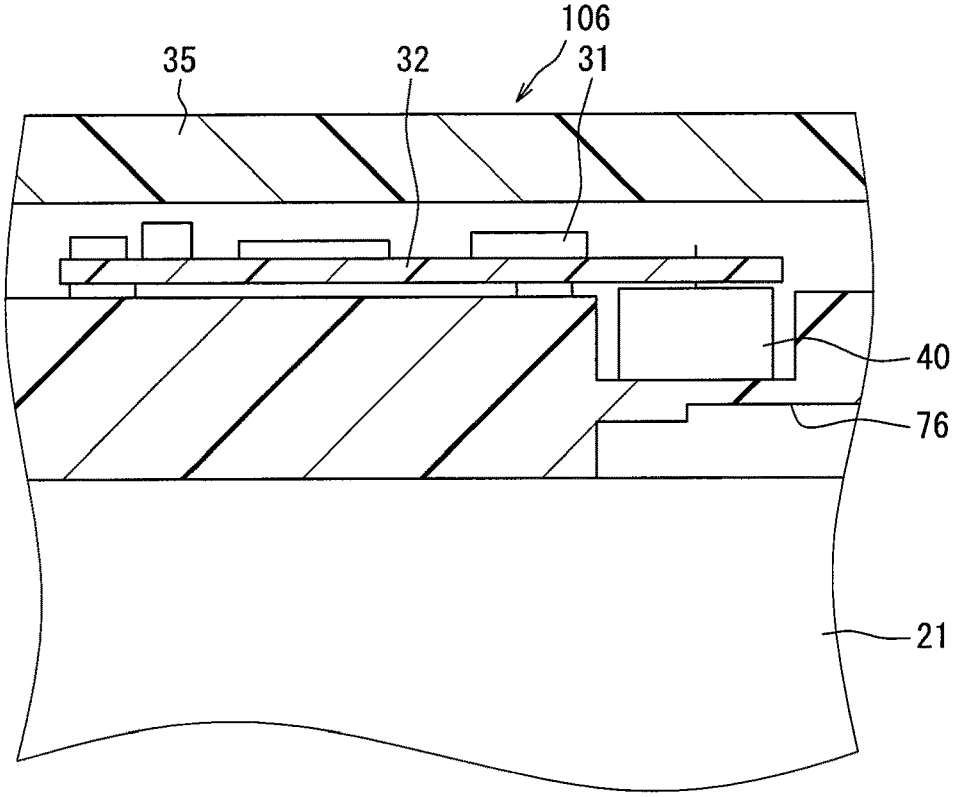
FIG. 8 is a sectional diagram illustrating a part of a compressor according to a sixth embodiment.

Next, a sixth embodiment of the present disclosure will be described referring to FIG. 8. In the present embodiment, a limiting structure is formed in an intake housing 34. In FIG. 8, an exterior of a motor housing 21 is shown to facilitate understanding.

The limiting structure is a recess portion 76 formed in the intake housing 34, and the recess portion 76 is recessed inward and formed between the electric filter member 40 and a discharge passage 42. According to this, the motor housing 21 that accommodates a compressor 106 and a part of the intake housing 34 on which the electric filter member 40 is attached is not in contact with each other. A heat transfer from an intake passage 34*a* can be limited by the recess portion 76.

In a part of a separation wall on which the electric filter member 40 is attached, an intake passage 34*a* side is thicker than an outer circumference side (right hand side in FIG. 8) of the intake housing 34. According to this, a heat transfer to a low-temperature part of the separation wall increases, and a temperature increase of the electric filter member 40 can be limited.

In the present embodiment, the recess portion 76 is formed in the intake housing 34, but the recess portion 76 may be formed in another member instead of the intake housing 34. The recess portion 76 may be formed in an inverter housing 35 or in a motor housing 21, for example.

Seventh Embodiment

Figure 9:
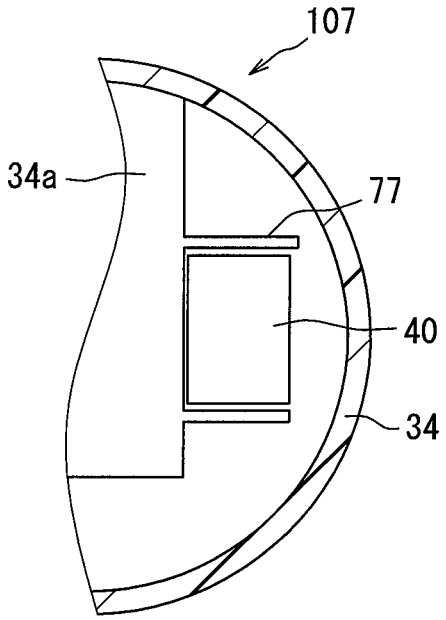
FIG. 9 is a plan view illustrating a part of a compressor according to a seventh embodiment.

Next, a seventh embodiment of the present disclosure will be described referring to FIG. 9. In the present embodiment, an enhancing structure is formed in the intake housing 34.

In an intake housing 34, an enhancing rib 77 in which a heat is easy to be transferred from a fluid flowing in an intake passage 34*a* is provided. The enhancing rib 77 is the enhancing structure and surrounds an electric filter member 40.

In other words, the enhancing ribs 77 extend from a surface of the intake housing 34 which partitions the low-temperature intake passage 34*a* and the electric filter member 40, and the enhancing ribs 77 extend along two surfaces of the electric filter member 40 perpendicular to a surface of the electric filter member 40 adjacent to the intake passage 34*a*. Since the enhancing rib 77 extends from the surface that is cooled by the intake refrigerant, the low-temperature heat is transferred. Accordingly, the enhancing rib 77 cools the electric filter member 40, and the temperature increase of the electric filter member 40 can be limited.

Eighth Embodiment

Figure 10:
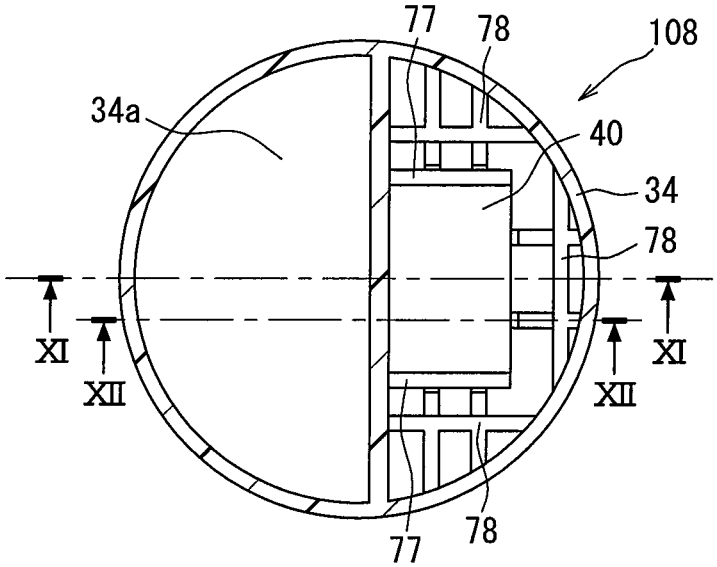
FIG. 10 is a plan view illustrating a part of a compressor according to an eighth embodiment.

Next, an eighth embodiment of the present disclosure will be described referring to FIGS. 10 to 12. An intake housing 34 of the present embodiment is similar to that of the seventh embodiment. In the present embodiment, a heat dissipation rib 78 is provided in the intake housing 34 as well as an enhancing rib 77. The enhancing rib 77 contacts at least a part of a surface of an electric filter member 40. In the present embodiment, the enhancing rib 77 contacts two lateral surfaces of the electric filter member 40. The enhancing rib 77 of the present embodiment may contact both a first lateral surface and a second lateral surface of the electric filter member 40. The first surface is an opposite surface of the second surface. According to this, a low-temperature heat is transferred from an intake passage 34*a* to the lateral surfaces, and accordingly a temperature increase of the electric filter member 40 can be limited.

Figure 11:
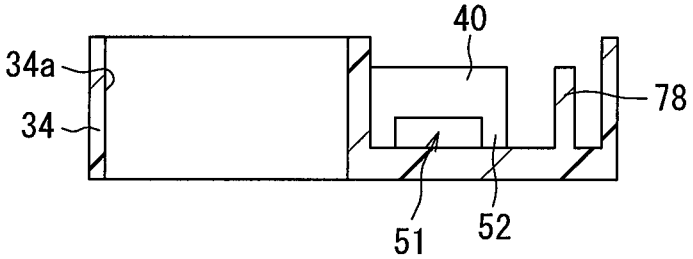
FIG. 11 is a sectional diagram taken along a line XI-XI of FIG. 10.
Figure 12:
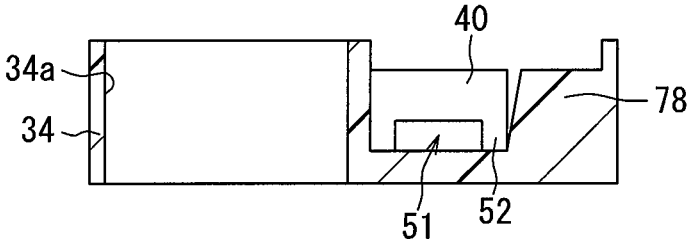
FIG. 12 is a sectional diagram taken along a line XII-XII of FIG. 10.

As shown in FIGS. 11 and 12, multiple heat dissipation ribs 78 are provided at the bottom of the intake housing 34 and around the electric filter member 40. According to this, a heat from a discharge passage 42 can be dissipated to parts other than the electric filter member 40. Accordingly, a heat transfer from the discharge passage 42 to the electric filter member 40 can be limited.

Moreover, the heat dissipation rib 78 is capable of improving strength of the intake housing 34. Accordingly, a deformation and a wreck of the electric filter member 40 caused by an impulse from an outside can be limited.

The heat dissipation rib 78 does not contact the enhancing rib 77 and the electric filter member 40. In other words, the heat dissipation rib 78 changes its shape according to a part where the impulse from the outside is added, and accordingly the heat dissipation rib 78 improves strength of the intake housing 34. As shown in FIG. 12, the heat dissipation rib 78 has a slope-shape surface so as not to contact the electric filter member 40. This configuration broadens an area in which the impulse from the outside can be absorbed just by the change of the shape of the heat dissipation rib 78, and accordingly the deformation and the wreck of the electric filter member 40 can be limited.

Ninth Embodiment

Figure 14:
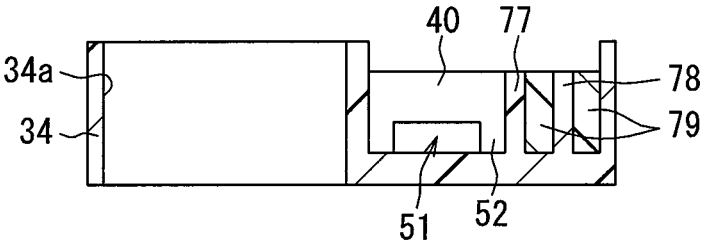
FIG. 14 is a sectional diagram taken along a line XIV-XIV of FIG. 13.
Figure 15:
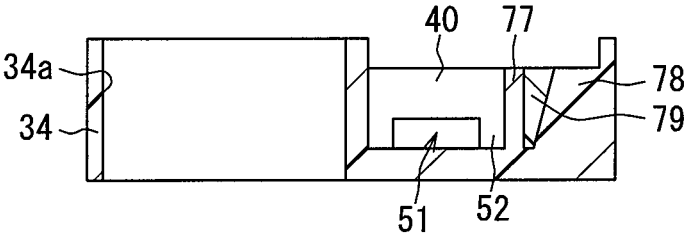
FIG. 15 is a sectional diagram taken along a line XV-XV of FIG. 13.

Next, a ninth embodiment of the present disclosure will be described referring to FIGS. 13 to 15. An intake housing 34 of the present embodiment is similar to that of the eighth embodiment. In the present embodiment, both an enhancing rib 77 and a heat dissipation rib 78 are provided. The enhancing rib 77 surrounds and contacts four lateral surfaces of an electric filter member 40. According to this, a low-temperature heat is transferred from the intake passage 34*a* to the lateral surfaces of the electric filter member 40, and a temperature increase of the electric filter member 40 can be limited. Moreover, since the electric filter member 40 is easy to be positioned, a mounting of the electric filter member 40 can be facilitated.

Figure 13:
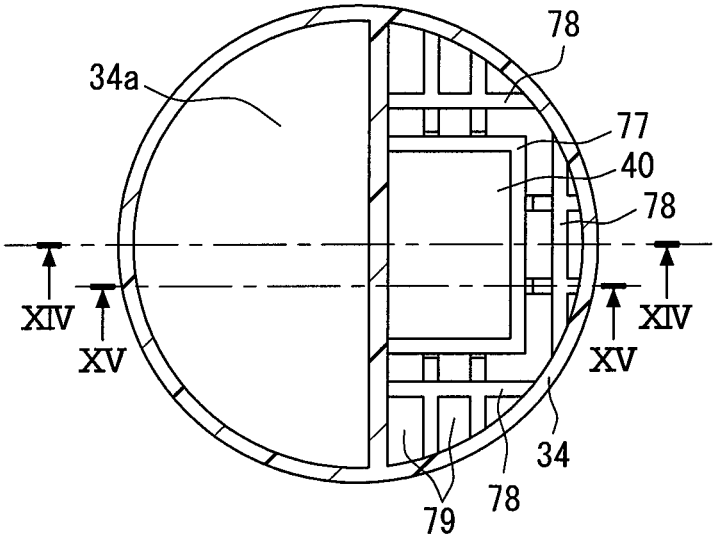
FIG. 13 is a plan view illustrating a part of a compressor according to a ninth embodiment.

Multiple heat dissipation rib 78 that are protrusions are provided at intervals, as shown in FIG. 13. Between the heat dissipation ribs 78, a fiber member 79 is provided for improving a strength, as shown in FIGS. 14 and 15. The fiber member 79 is made of aramid fibers, for example. According to this, the intake housing 34 can be lightened compared to a case where gaps are filled with the same material as the intake housing 34. Moreover, since a space for a change of shape of the heat dissipation rib 78 can be provided, a deformation and a wreck of the electric filter member 40 caused by an impulse from an outside can be limited.

While the present disclosure has been described with reference to embodiments thereof, it is to be understood that the disclosure is not limited to the embodiments and constructions. The present disclosure is intended to cover various modification and equivalent arrangements.

The configurations of the above-described embodiments are just examples, and the present disclosure is not limited to those.

The compression mechanism is a rotary type in the first embodiment. However, the compression mechanism is not limited to the rotary type. The compression mechanism may be other type compression mechanism such as a swash plate type or a scroll type.

In the first embodiment, the fluid is the refrigerant, and the electric compressor 10 is the electric refrigerant compressor. However, the fluid is not limited to the refrigerant, and the fluid may be other fluid. The compressor 10 constitutes the refrigeration cycle, but the compressor 10 may be used for other purpose.

In the first embodiment, the low-temperature component is the electric filter member 40. However, the low-temperature component is not limited to this. The electric filter member 40 may be exchanged with another electronic component 31, and the heat transfer to the electronic component 31 may be limited by the limiting structure. In the first embodiment, the limiting structure is provided only for the electric filter member 40, but the limiting structure may be provided for another electronic component 31, too.

While the present disclosure has been described with reference to embodiments thereof, it is to be understood that the disclosure is not limited to the embodiments and constructions. The present disclosure is intended to cover various modification and equivalent arrangements. In addition, while various combinations and configurations are shown in the present disclosure, other combinations and configurations, including more, less or only a single element, are also within the spirit and scope of the present disclosure.

What is claimed is:

1. An electric compressor comprising:

a compression portion that compresses and discharges a drawn fluid;

a motor that is a power source of the compressor;

an actuator that includes a plurality of electronic components and drives the motor;

a first casing that accommodates the actuator; and a second casing that accommodates the compression portion and the motor, wherein the second casing includes a discharge passage in which the high-temperature fluid compressed by the compression portion flows, and a limiting structure that limits a heat transfer from the fluid flowing in the discharge passage is provided between at least one of the plurality of electronic components and the discharge passage, and the limiting structure includes a seat portion that defines a gap between a bottom surface of the at least one of the plurality of electronic components and the discharge passage, the seat portion being provided in the first casing separately from the first casing.

2. The electric compressor according to claim 1, wherein the second casing includes an intake passage in which the low-temperature fluid drawn by the compression portion flows, the plurality of electronic components include a high-temperature component that generates heat to be high temperature, and a low-temperature component that generates heat lower in temperature than heat generated by the high-temperature component, a heat dissipation structure in which the heat from the fluid flowing in the intake passage is easy to be transferred is provided between the high-temperature component and the intake passage, and the limiting structure is provided between the low-temperature component and the discharge passage.

3. The electric compressor according to claim 1, wherein the limiting structure includes a limiting portion that is integrated with the at least one of the plurality of electronic components and limits the heat transfer on a surface of the at least one of the plurality of electronic components facing the discharge passage.

4. The electric compressor according to claim 3, wherein the limiting portion is a gap forming portion that defines a hollow space.

5. The electric compressor according to claim 3, wherein the limiting portion is an outer layer of the at least one of the plurality of electronic components, the outer layer including a material having a low thermal conductance.

6. The electric compressor according to claim 1, wherein the limiting structure includes a recess portion that is provided between the at least one of the plurality of electronic components and the discharge passage, the recess portion being provided in at least one of the first casing and the second casing, and the recess portion being recessed inward.

7. The electric compressor according to claim 1, wherein the second casing includes an intake passage in which a low-temperature fluid drawn by the compression portion flows, an enhancing structure in which heat from the fluid flowing in the intake passage is easy to be transferred is integrated with the first casing, and the enhancing structure surrounds the at least one of the plurality of electronic components.

8. The electric compressor according to claim 7, wherein the enhancing structure surrounds the at least one of the plurality of electronic components and contacts at least a part of a surface of the at least one of the plurality of electronic components.

9. The electric compressor according to claim 1, wherein the plurality of electronic components includes a high-temperature component that generates heat to be high temperature, and a low-temperature component that generates heat lower in temperature than the heat generated by the high-temperature component, and a protrusion is provided around a part of the first casing in which the high-temperature component is provided.

10. The electric compressor according to claim 9, wherein a plurality of the protrusions are provided at intervals, and a fiber member is provided between the plurality of protrusions.

11. An electric compressor comprising:

a compression portion that compresses and discharges a drawn fluid;

a motor that is a power source of the compressor;

an actuator that includes a plurality of electronic components and drives the motor;

a first casing that accommodates the actuator; and a second casing that accommodates the compression portion and the motor, wherein the second casing includes a discharge passage in which the high-temperature fluid compressed by the compression portion flows, a limiting structure that limits a heat transfer from the fluid flowing in the discharge passage is provided between at least one of the plurality of electronic components and the discharge passage, the plurality of electronic components include a high-temperature component that generates, heat to be high temperature, and a low-temperature component that generates heat lower in temperature than heat generated by the high-temperature component, a plurality of protrusions are provided at intervals around a part of the first casing in which the high-temperature component is provided, and a fiber member is provided between the plurality of protrusions.

* * * * *